United States Patent [19]

Mongeon

[11] 4,257,037

[45] Mar. 17, 1981

[54] INDICATOR AND ALARM FOR BURGLAR ALARMS AND THE LIKE

[75] Inventor: Ronald W. Mongeon, San Jose, Calif.

[73] Assignee: Stellar Systems, Inc., San Jose, Calif.

[21] Appl. No.: 66,622

[22] Filed: Aug. 15, 1979

[51] Int. Cl.[3] ..... G08B 25/00

[52] U.S. Cl. ..... 340/533; 340/524

[58] Field of Search ..... 340/500, 505, 506, 517, 340/518, 521, 524, 533, 541, 545, 58, 60

[56] References Cited

U.S. PATENT DOCUMENTS

| | | | |
|---|---|---|---|
| 3,550,090 | 12/1970 | Baker, Jr. et al. | 340/60 |
| 3,739,376 | 6/1973 | Keledy | 340/533 |

*Primary Examiner*—Alvin H. Waring

*Attorney, Agent, or Firm*—Robert G. Slick

[57] ABSTRACT

A detector and indicator for burglar alarms is provided wherein passive resonators, each tuned to a different frequency, are employed across each of the normally closed series switches of the burglar alarm. An alternating current generator is connected to the series line and tuned progressively to the frequency of each of the passive resonators. If an open circuit occurs across any of the resonators, a detector circuit detects the high impedance which results and actuates an indicator circuit wherein the indicator is selected for the frequency of the resonator of a particular location. Even if a plurality of switches are open, the selection circuit will be activated for the particular locations of the open switches.

9 Claims, 4 Drawing Figures

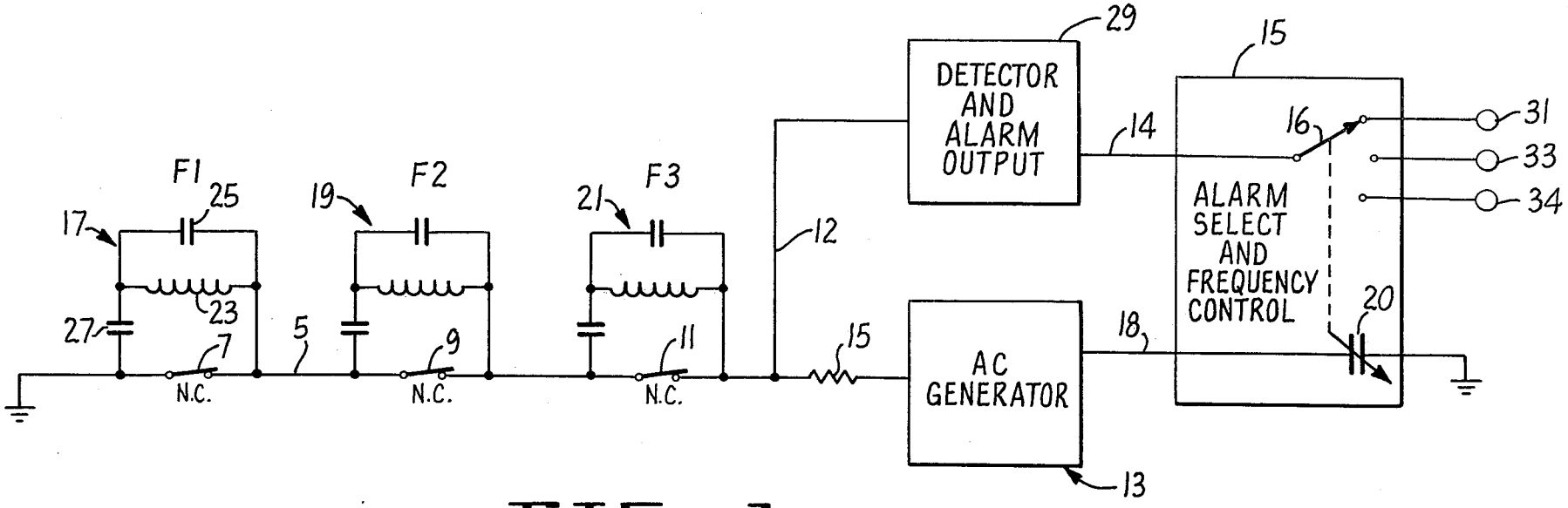
FIG. 1.
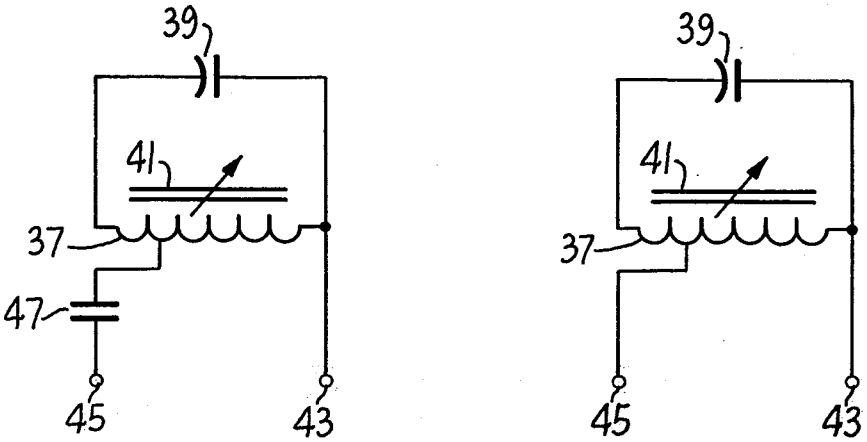
FIG. 2.
FIG. 3.

INDICATOR AND ALARM FOR BURGLAR ALARMS AND THE LIKE

SUMMARY OF THE INVENTION

Most burglar alarm systems employ a plurality of door or window switches which are in series and which are supplied with a steady current, normally DC. If any one of the switches is opened, an alarm is set off.

The difficulty with such a system is that there is no indication of which of a number of switches is open. Thus, one only knows that there has been an intrusion. Although this is a reasonably satisfactory system for a small installation, such as a private home, it is completely inadequate for a large installation such as a factory wherein many switches at widely spaced intervals may be provided in the circuit.

In accordance with the present invention, a simple detection circuit is provided wherein a large number of locations can be monitored in such a manner that the location of an open switch is immediately ascertained.

Accordingly, it is an object of the present invention to provide an indicator device in a burglar alarm which will immediately signal the location of an intrusion.

Another object of the present invention is to provide a system wherein only a single wire is employed connecting all of the location switches in series so that one can detect the place of an intrusion without the necessity of running separate wires from each of the locations to an indicator board.

In accordance with another object of the invention, a system is provided wherein two or even more switches can be opened at the same time yet the indicator will accurately pinpoint those locations, even in the case of a multiple intrusion.

Another object of the present invention is to provide an indicator system which can be wired into existing direct current systems without destroying the effectiveness of the existing alarm sytem.

Various other objects and advantages of the invention will be brought out in the balance of the specification.

BRIEF DESCRIPTION OF THE DRAWINGS

FIG. 1 is a block diagram which is used to illustrate the theory of the invention.

FIG. 2 is a schematic diagram of a passive resonator suitable for use in conjunction with an existing burglar alarm system.

FIG. 3 is a schematic diagram of a similar passive resonator suitable for use in new installations.

DESCRIPTION OF THE PREFERRED EMBODIMENTS

Figure 4:
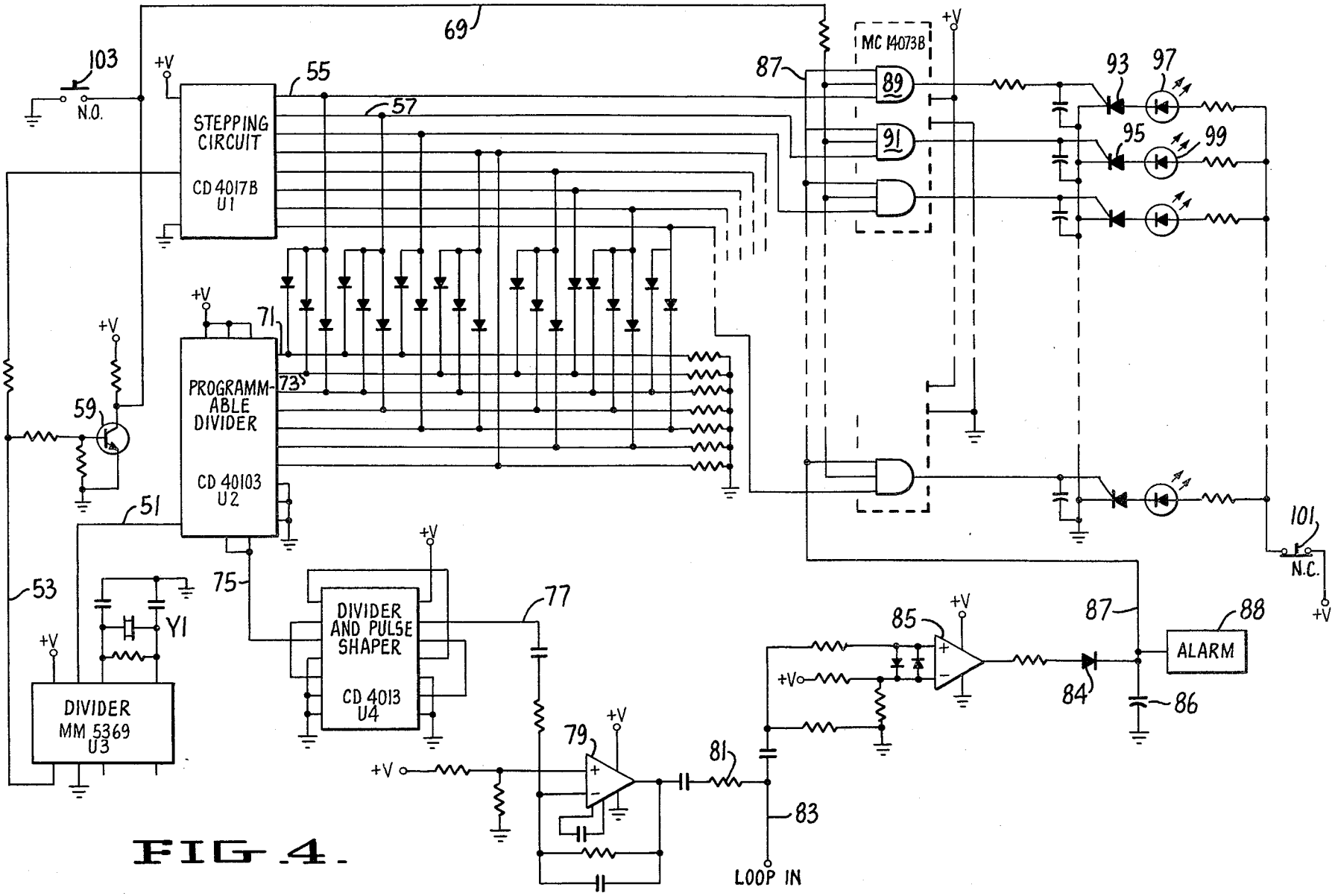
FIG. 4 is a schematic diagram of a preferred circuit for carrying out the present invention.

Referring now to the block diagram of FIG. 1, a burglar alarm has a single wire 5 with a number of normally closed switches 7, 9 amd 11 in series therein. An AC generator 13 is connected to line 5 through a resistor 15. The AC generator is capable of generating a plurality of preselected frequencies and is connected by line 18 to the controller 15 which selects a series of successive frequencies as is later explained.

Across each of the switches 7, 9 and 11 is a parallel tuned circuit, i.e. a passive resonator, generally designated 17, 19 and 21, each of which consists of an inductance 23 and a capacitor 25. The circuit may also contain a large blocking capacitor 27. The passive resonators 17, 19 and 21 are tuned to different frequencies which are designated F1, F2 and F3. A detector circuit 29 is provided which detects any voltage in excess of a preset threshold developed on line 12 and produces an output on line 14 in case such a voltage is detected. The alarm select and frequency control 15 has three indicator outputs designated 31, 33 and 34 connected by switch 16. A frequency control element 20 is coordinated with switch 16 so that as indicator 31 is connected frequency F1 is generated and so on. Thus, the control 15 successively causes AC generator 13 to generate frequencies F1, F2 and F3 in order and at the same time to internally connect the output into the appropriate one of the indicators 31, 33 and 34. There will be no output of any of these indicators unless there has been an input on line 14.

The device works as follows: The AC generator 13 is programmed to first put out frequency F1 and connect the selector circuit 15 to the indicator 31. If switch 7 is open, there will be a high impedance at the frequency F1 which will develop a voltage on line 12. This will be detected by 29 and the output taken through line 14 through switch 16 which would light the indicator light 31. However, if frequency F1 is being generated and switch 7 is closed and 9 and/or 11 is open, there would be no output through line 12 since the other resonators would have a low impedance at frequency F1.

Next, the frequency would be stepped to F2 which in effect would interrogate the resonator 19 to determine whether there was a high impedance across it. Of course, if the switch 9 is closed, there would be no voltage developed on line 12.

It will be apparent from the above that this circuit is capable of detecting whether any one of the switches 7, 9 and 11 is open even when two or more of the switches are open.

It was mentioned earlier that a blocking capacitor 27 might be used. The use of this capacitor is not necessary on new installations but it is necessary if the circuitry of the present invention is to be utilized with an existing alarm circuit using DC or house frequency AC. Of course, the capacitor should be chosen to have a low impedance at any of the frequencies which are used in the detection circuit; it permits the operation of the existing alarm system with the indicator of the present invention.

A typical passive reasonator is shown in FIG. 2 suitable for use in an existing circuit. Here the inductance 37 forms a parallel tuned circuit with capacitor 39 and has a very high impedance at a desired frequency. For compactness, inductance 37 is preferably wound on a suitable cup core 41 of ferrite composition. Output lines 43 and 45 are employed with a blocking capacitor 47 in one line. It will be noted that line 45 is tapped down on inductance 37 to obtain the equivalent of a high C to L ratio resonator using practical value capacitors. FIG. 3 is exactly the same as FIG. 2 except that the blocking capacitor 47 has been eliminated. Blocking capacitor 47 is not needed for new installations wherein it is not desired to use a low-frequency or DC alarm circuit along with the circuit of the present invention.

In FIG. 4 a practical circuit for carrying out the present invention is shown. Here a crystal Y1 generates a desired frequency such as 810 kHz. (Hereafter, various frequencies are called out but it will be understood that these are only for purposes of illustration and may be altered at will.) U3 serves both to drive the crystal Y1 and also acts as a divider. U3 has two outputs, first the crystal frequency itself which is taken through line 51 to the input of the programmable divider U2 and a divided output at a low frequency such as 13 Hz through line 53. Line 53 goes to the input of a stepping circuit U1 which provided a plurality of DC outputs successively on lines 55, 57 and so on each time line 53 goes high. Output from line 53 is also fed to the base of transistor 59 which acts as inverter, the output being taken through line 69 which serves as an enable line as later described in detail.

As was previously mentioned, U2 is a programmable divider and receives the crystal output through line 51. This programmable divider is actuated by direct current inputs on its lines 71, 73 and so on and produces output frequencies F1, F2, F3 . . . FX on line 75 depending upon which of its DC inputs goes high. The thus divided output on line 75 is passed to U4 which is a divider and pulse shaper so that the output frequency taken on line 77 is substantially a square wave with a 50 percent duty cycle. This line leads to the inverting input of amplifier 79 and the output goes through resistor 81 to the loop in connector 83 and to the threshold level control 85. If the impedance of the loop is low, no voltage is developed at the input of the level detector 85, but if it is high, the voltage is applied to the level detector 85. If the voltage is above the threshold, the positive peaks are detected by diode 84 which tends to charge capacitor 86. Capacitor 86 acts as an integrator so that several positive peaks are required to make line 87 go high, thus transients will not cause a false alarm. The voltage thus developed may be used to actuate alarm 88 but its primary purpose is to actuate a selected location indicator.

A plurality of three input port AND gates 89, 91 and so on have outputs leading to corresponding SCR's 93 and 95 connected to the LED's 97 and 99.

Obviously, there will be a number of AND gates, SCR's and LED's corresponding to the number of frequencies generated or, in other words, the number of potentially open swtiches to be detected. Each of the AND gates has three input ports, the enable line 69 and line 87 being common to two of the input ports of all of the AND gates 25 shown. The third input of each AND gate has a separate line to U1 so that line 55 connects to AND gate 89, line 57 connects to AND gate 91 and so on.

It will be understood, of course, that the loop-in line 83 leads to a line having a plurality of series switches each of which is shunted by a parallel tuned circuit, selected from FIG. 2 or FIG. 3 and as shown in FIG. 1. It will also be understood that the frequency of each tuned circuit will correspond to one of the frequencies developed in line 77.

It is believed apparent from the foregoing description how the circuit operates. U3 generates a low-frequency stepping voltage which causes successive positive outputs on the lines 55, 57 and so on of U1. The lines are connected to one input of the AND gates and also to one input of the programmable divider U2. The programmable divider coupled with divider and pulse shaper U4 generates successive frequencies corresponding to the resonant frequencies of the passive resonators. If a particular switch is open, diode 84 will detect a high impedance at that particular frequency causing line 87 to go high after several pulses. During the second half of each output cycle on line 53, the inverter 59 will cause line 69 to go high. The purpose of this inverter is to keep the AND gates off while the frequency switching is taking place, thus avoiding false alarms during the switching from one frequency to the next so the line 69 goes high only during the second half of the switching cycle. Now that both lines 69 and 87 are high, the third input port of the appropriate AND gate will go high by its connection to U1 causing its output port to go high, actuating the corresponding indicator such as 97. Once an indicator has been set off, it will stay lit because of the action of the SCR acting as a latch and will not go off until the normally closed reset switch 101 is actuated. At the same time, alarm 88, if used, will be activated. Thus, alarm 88 will indicate any intrustion and the indicators will show the point of the intrusion.

At times, it is desired to freeze the circuit in which case the freeze switch 103 is closed, grounding line 69 and preventing further impulses in line 87 from setting off an alarm. However, any indicators already on will stay on due to the action of the SCR's.

Although a specific embodiment of the invention has been shown utilizing certain specific components, it will be recognized that this is only one particular embodiment of a broad inventive concept and that other methods and components could be employed carrying out the purposes of the present invention. For instance, other frequency generating and strobing means could be employed. It is not necessary that frequency changes be in discrete steps and could be generated by a V.F.O. sweeping across the frequencies of the resonators. Further, it has been assumed that the system would be used as a burglar alarm. Obviously, the system has much broader application and can be used in any situation wherein one has a plurality of switches and wishes to detect which of the switches migh be open. For instance, the system could be used in fire alarms, chemical process control and the like.

I claim:

1. An indicator for a system having a plurality of switches in series in a loop wherein it is desired to know which of said switches is open comprising in combination:

a. a passive resonator across each of said switches, said resonator having a high impedance at its resonant frequency and a low impedance at all other frequencies, b. each of said resonators being tuned to a different frequency, c. an AC generator for generating a series of frequencies encompassing the resonant frequencies of said passive resonators, d. detection means for detecting a high impedance in said loop, and e. indicating means to indicate the frequency at which a high impedance is detected.

2. The indicator of claim 1 wherein the AC generator is connected to the loop through a resistor and the detection means detects a voltage developed across the loop when the impedance is high at a particular frequency.

3. A circuit in accordance with claim 1 having an oscillator having a first output to a first divider to produce a low-frequency stepping voltage and a second high-frequency output into a programmable divider, the stepping voltage from said first divider feeding a stepping circuit to actuate the high frequency input of said programmable divider to produce a series of successive frequencies wherein said successive frequencies are fed to a plurality of AND gates and wherein the output from said stepping circuit is also provided to said AND gates whereby an AND gate corresponding with a preselected frequency will be actuated upon the detection of a high impedance at said preselected frequency.

4. The circuit in accordance with claim 3 wherein the low-frequency stepping voltage is fed to an inventer and the inventer output is fed to a plurality of three input AND gates, thus eliminating false alarms which may be caused by transients occurring during switching from one frequency to the next.

5. The circuit of claim 3 wherein the oscillator is a crystal oscillator.

6. The circuit of claim 1 wherein each resonator includes an inductance and a capacitor in parallel.

7. The resonator of claim 6 wherein the output is tapped down on the inductance.

8. The resonator of claim 6 wherein the resonator includes an inductance comprising a winding wound on a pot core of a ferrite.

9. The resonator of claim 6 having a blocking capacitor in series, said capacitor permitting use with existing alarm systems.

* * * * *